United States Patent [19]

Schaffhauser et al.

[11] Patent Number: 4,691,264

[45] Date of Patent: Sep. 1, 1987

[54] STATIC AMPLIFICATION STUN GUN

[76] Inventors: Brian E. Schaffhauser; George Spector, both of 233 Broadway, Rm. 3615, New York, N.Y. 10007

[21] Appl. No.: 778,983

[22] Filed: Sep. 23, 1985

[51] Int. Cl.[4] ..... F41B 15/04

[52] U.S. Cl. ..... 361/232

[58] Field of Search ..... 361/232, 235

[56] References Cited

U.S. PATENT DOCUMENTS 3,599,038 8/1971 Skidmore ..... 361/235 X
3,997,817 12/1976 Secker ..... 361/235 X
4,162,515 7/1979 Henderson et al. ..... 361/232
4,486,807 12/1984 Yanez ..... 361/232

FOREIGN PATENT DOCUMENTS 2456111 6/1975 Fed. Rep. of Germany ..... 361/232

*Primary Examiner*—Donald A. Griffin

[57] ABSTRACT

A static amplification stun gun is provided and consists of a pistol shaped housing. A canted cam lever trigger compresses a piezoelectric crystal producing a static charge which is stored in a capacitor. A grounded target, such as an unruly person receives the charge through the air from a probe at the end of the gun.

5 Claims, 5 Drawing Figures

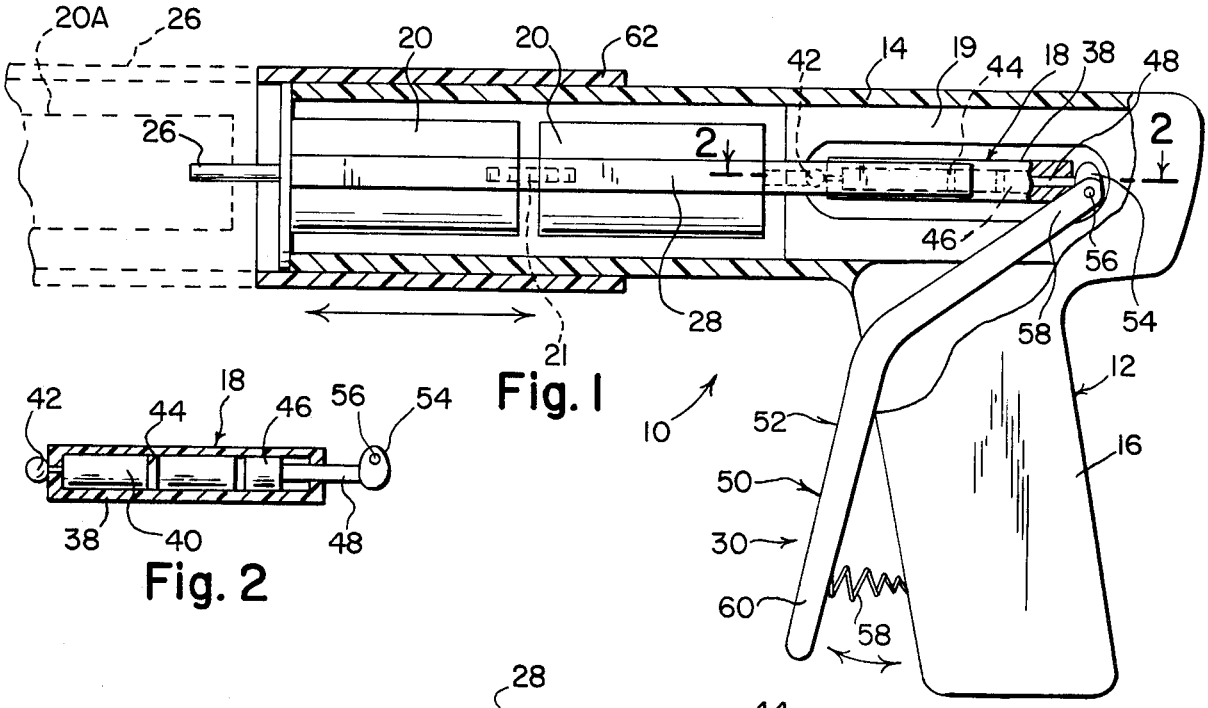
Fig. 1
Fig. 2
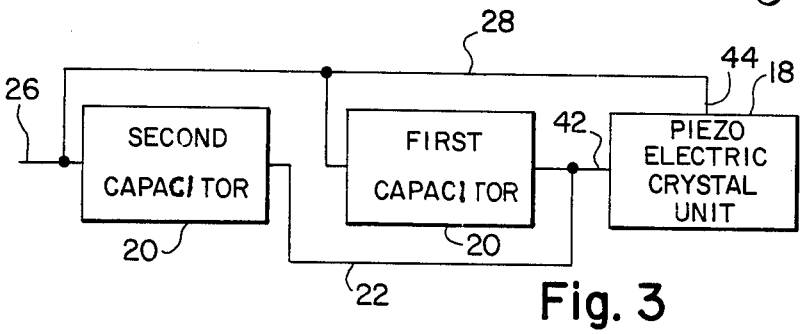
Fig. 3
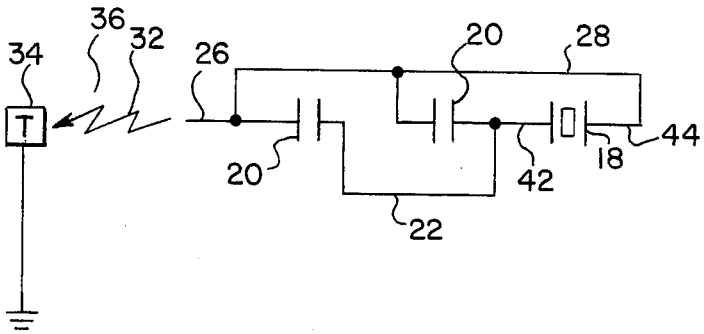
Fig. 4
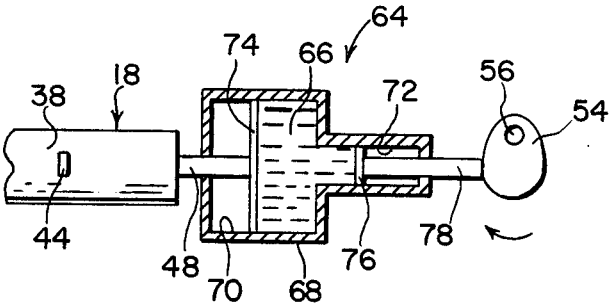
Fig. 5

STATIC AMPLIFICATION STUN GUN

BACKGROUND OF THE INVENTION

The instant invention relates generally to electrical shocking devices and more specifically it relates to a static amplification stun gun.

Numerous electrical shocking devices have been provided in prior art that are adapted to use batteries as power sources to impart non-fatal, jolting shocks as deterrents to unruly persons. For example, U.S. Pat. Nos. 4,092,695; 4,162,515 and 4,486,807 all are illustrative of such prior art. While these units may be suitable for the particular purpose to which they address, they would not be as suitable for the purposes of the present invention as heretofore described.

SUMMARY OF THE INVENTION

The static amplification stun gun contains at least two capacitors coupled to a piezoelectric crystal. A canted cam lever trigger compresses the crystal producing a static charge which is then stored in the capacitors. A grounded target, such as an unruly person, can receive the static charge through the air from a probe at the end of the gun.

A principle object of the present invention is to provide a static amplification stun gun that overcomes the shortcomings of the prior art devices.

Another object is to provide a static amplification stun gun that uses a piezoelectrical crystal, activated by a canted cam lever, as a power source in combination with capacitors to impart non-fatal, jolting shocks as deterrents to unruly persons.

An additional object is to provide a static amplification stun gun that uses a stepped-up hydraulic cylinder between the canted cam lever and the piezoelectrical crystal to increase the pressure within the crystal to raise the static amplification therein.

A further object is to provide a static amplification stun gun that is simple and easy to use.

A still further object is to provide a static amplification stun gun that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a side view of the invention with parts broken away.

FIG. 2 is a vertical cross sectional view of the piezoelectric crystal components taken along line 2—2 in FIG. 1.

FIG. 3 is a block diagram of the circuit.

FIG. 4 is an electronic diagram of the circuit.

FIG. 5 is a modification of the cranking linkage of the piezoelectric crystal partly in cross section showing a stepped-up hydraulic cylinder between the cam and the crystal.

DETAILED DESCRIPTION OF THE PREFERRED EMBODIMENTS

Turning now descriptively to the drawings, in which similar reference characters denote similar elements throughout the several views, FIGS. 1 through 4 illustrate a static amplification stun gun 10 containing in combination a non-conductive pistol shaped housing 12 that has a hollow barrel 14 and an insulated hand grip 16. A piezoelectric crystal unit 18 is positioned within a frame 19 in the barrel 14. Two capacitors 20 are positioned within the barrel 14 with a non-conductive connector 21 and are operatively connected to the piezoelectric crystal unit 18 via contact line 22 while a probe 26 is positioned on end of the barrel 14 and operatively connected to the capacitors 20 and the piezoelectric crystal unit 18 via contact line 28.

A trigger 30 is provided in the hand grip 16 for activating the piezoelectric crystal unit 18 producing a static charge 32 which is then stored in the capacitors 20 until a grounded target 34, such as an unruly person, can receive the static charge 32 through the air 36 from the probe 26.

The stun gun 10 is shown with two capacitors 20 but it can work with at least one capacator. Power can be varied by increasing the size of the piezoelectric crystal unit 18 and the capacators 20.

As best seen in FIG. 2 the piezoelectric crystal unit 18 contains an insulated cylinder 38 with a piezoelectric crystal 40 fixed within the cylinder. The unit 18 also contains two contact members 42 and 44 operatively connected to the piezoelectric crystal 40 and a piston 46 that has an arm 48. The piston 46 is slidable within the cylinder 38 to make contact and compress the piezoelectric crystal 40 with the arm 48 extending outwardly from end of the cylinder 38.

The trigger 30 includes a canted cam lever 50 to operate the piston arm 48 of the piezoelectric crystal unit 18. The cam lever 50 contains a hand lever member 52 extending from the hand grip 16 of the housing. A cam 54 is pivotally mounted at 56 to upper end 58 of the hand lever member 52. The cam 54 engages with the piston arm 48 to operate the piston 46 within the piezoelectric crystal unit 18 to produce the static charge 32.

A return spring 58 is mounted between lower end 60 of the hand grip 16 of the housing 12 to assist in returning the hand lever member 52 back to its normal non-operative position.

The stun gun 10 can also have a slideable telescopic sleeve 62 on the barrel 14. If another capacitor 20A shown in phantom is operatively connected to the stun gun 10 the probe 26 will be removed and replaced by another nonconductive connector 21. The probe 26 will now be placed on the end of the capacitor 20A (not shown) with the capacitor 20A properly connected to contact lines 22 and 28. This will increase the storage capacity for the static charge 32.

FIG. 5 shows a stepped-up hydraulic cylinder 64 that has liquid 66 therein. The cylinder 64 is mounted between the piston arm 48 of the piezoelectric crystal unit 18 and the cam 54 of the canted cam lever 50.

The hydraulic cylinder 64 contains a body 68 that has a large chamber portion 70 and a small chamber portion 72 therein. A large piston 74 is mounted to the piston arm 48 of the piezoelectric crystal unit 18 which extends within the large chamber portion 70 of the body 68.

A small piston 76 that has an arm 78 is slideable within the small chamber portion 72 of the body 68 and extends outwardly therefrom to make contact with the cam 54. When the cam 54 pivots and engages with the small piston arm 78, the small piston 76 will compress the liquid 66 to activate the large piston 74, this increase compression of the piezoelectric crystal 40 which will increase the static charge 32.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A static amplification stun gun comprising in combination:

(a) a non-conductive pistol shaped housing having a hollow barrel and an insulated hand grip;

(b) a piezoelectric crystal unit positional within said barrel;

(c) at least one capacitor postioned within said barrel and operatively connected to said piezoelectric crystal unit;

(d) a probe positioned on an end of said barrel and operatively connected to said capacitor and said piezoelectric crystal unit; and (e) a trigger means in said hand grip for activating said piezoelectric crystal unit producing a static charge which is then stored in said at least one capacitor until a grounded target, such as an unruly person, can receive said static charge through the air from said probe, wherein said piezoelectric crystal unit comprises:

(f) an insulated cylinder;

(g) a piezoelectric crystal fixed within said container;

(h) two contact members operatively connected to said piezoelectric crystal; and (i) a piston having an arm, said piston slidable within said cylinder to make contact and compress said piezoelectric crystal with said arm extending outwardly from an end of said cylinder.

2. A static amplification stun gun as recited in claim 1, wherein said trigger means includes a canted cam lever to operate said piston arm of said piezoelectric crystal unit.

3. A static amplification stun gun as recited in claim 2, wherein said canted cam lever comprises:

(j) a hand lever member extending from said hand grip of said housing;

(k) a cam pivotally mounted to upper end of said hand lever member whereby said cam engages with said piston arm to operate said piston within said piezoelectric crystal unit to produce said static charge.

4. A static amplification stun gun as recited in claim 3, wherein said canted cam lever further includes a return spring mounted between lower end of said hand lever member and said hand grip of said housing to assist in returning said hand lever member back to its normal non-operative position.

5. A static amplification stun gun as recited in claim 4, further comprising a stepped-up hydraulic cylinder having liquid therein mounted between said piston arm of said piezoelectric crystal unit and said cam of said canted cam lever, said hydraulic cylinder comprising:

(l) a body having a large chamber portion and a small chamber portion therein;

(m) a large piston mounted to said piston arm of said piezoelectric crystal unit extending within said large chamber portion of said body; and (n) a small piston having an arm slideable within said small chamber portion of said body and extending outwardly therefrom to make contact with said cam so that when said cam pivots and engages with said small piston arm said small piston will compress said liquid to activate said large piston thus operating said piston of said piezoelectric crystal unit, to increase compression of said piezoelectric crystal which will increase said static charge.

* * * * *